US006173699B1

(12) United States Patent
Kasen

(10) Patent No.: US 6,173,699 B1
(45) Date of Patent: Jan. 16, 2001

(54) HYDRAULICALLY-ACTUATED FUEL INJECTOR WITH ELECTRONICALLY ACTUATED SPILL VALVE

(75) Inventor: Jon E. Kasen, East Peoria, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/243,944

(22) Filed: Feb. 4, 1999

(51) Int. Cl.[7] ..... F02M 33/04
(52) U.S. Cl. ..... 123/446; 123/506
(58) Field of Search ..... 123/446, 496, 123/506

(56) References Cited

U.S. PATENT DOCUMENTS

| | | | | |
|---|---|---|---|---|
| 3,796,205 | | 3/1974 | Links . | |
| 4,593,668 | | 6/1986 | Yuzawa . | |
| 4,643,155 | | 2/1987 | O'Neill . | |
| 4,718,384 | | 1/1988 | Takahashi . | |
| 4,870,936 | | 10/1989 | Eheim . | |
| 5,094,216 | | 3/1992 | Miyaki . | |
| 5,115,783 | | 5/1992 | Nakamura . | |
| 5,121,730 | | 6/1992 | Ausman . | |
| 5,492,098 | | 2/1996 | Hafner . | |
| 5,517,972 | | 5/1996 | Stockner . | |
| 5,694,903 | | 12/1997 | Ganser . | |
| 5,713,520 | * | 2/1998 | Glassey et al. | 239/92 |
| 5,738,075 | * | 4/1998 | Chen et al. | 123/496 |
| 5,743,237 | * | 4/1998 | Matta | 123/496 |
| 5,819,704 | * | 10/1998 | Tarr et al. | 123/446 |
| 5,862,792 | | 1/1999 | Paul et al. . | |
| 5,893,347 | * | 4/1999 | McGee et al. | 123/496 |
| 5,957,111 | * | 9/1999 | Rodier | 123/458 |
| 5,979,415 | * | 11/1999 | Sparks et al. | 123/506 |
| 6,012,429 | * | 1/2000 | Beatty et al. | 123/446 |

FOREIGN PATENT DOCUMENTS 2 266 933 11/1993 (GB) .

* cited by examiner

*Primary Examiner*—Thomas N. Moulis
(74) *Attorney, Agent, or Firm*—Michael B. McNeil

(57) ABSTRACT

A hydraulically actuated fuel injector includes an injector body that defines an actuation fluid cavity and a nozzle outlet, and further defines a low pressure area and a fuel pressurization chamber in fluid communication with a spill passage. A pumping element is positioned in the injector body and moveable between a retracted position and an advanced position. The pumping element has a first end exposed to fluid pressure in the actuation fluid cavity and a second end exposed to fluid pressure in the fuel pressurization chamber. An electronic spill valve attached to the injector body is moveable between an open position in which the spill passage fluidly connects the fuel pressurization chamber to the low pressure area, and a closed position in which the spill passage is closed. Opening and closing of the spill valve during an injection event produces various rate shaping injection effects.

20 Claims, 2 Drawing Sheets

HYDRAULICALLY-ACTUATED FUEL INJECTOR WITH ELECTRONICALLY ACTUATED SPILL VALVE

TECHNICAL FIELD

The present invention relates generally to hydraulically-actuated fuel injectors, and more particularly to hydraulically-actuated fuel injectors having rate shaping through a fuel spillage valve.

BACKGROUND ART

Co-owned U.S. Pat. No. 5,492,098 to Hafner, et al., describes a hydraulically-actuated fuel injector having rate shaping through fuel spillage. Like many hydraulically-actuated fuel injectors, Hafner includes a pumping element or plunger that defines a portion of a fuel pressurization chamber. In order to produce a split injection at an idle condition, the Hafner, et al. plunger includes an annulus in fluid communication with the fuel pressurization chamber via several internal passageways. As the plunger is driven downward, the annulus comes briefly into registry with a spill passage defined by the injector body. When this occurs, fuel spills from the fuel pressurization chamber, and fuel pressure drops below a valve closing pressure sufficient to allow the nozzle needle valve to briefly close. In order to produce a split injection at idle, the plunger annulus is out of registry with the spill passage for the beginning and end portions of the plunger's stroke.

In part to increase the operating range of the Hafner, et al. injector, the actuation fluid pressure supplied to the injector is adjusted to be relatively low at idle but relatively high at rated conditions. These differing pressures allow the injector to inject a very small amount of fuel at idle, but a relatively large amount of fuel at a rated condition. This actuation fluid pressure difference also results in the plunger moving at significantly different rates at idle and rated conditions. Because the plunger moves relatively slowly at the idle condition, the plunger annulus is in registry with the spill passage for a sufficient duration that a split injection can occur; however, because the plunger moves so quickly at a rated condition, the plunger annulus moves past the spill passage so quickly that very little spillage occurs and no split injection takes place. Because of the stroke length limitations available for the Hafner, et al. plunger, it would be difficult to modify in a way that could produce a split injection, or other significant rate shaping completely across its operating range. Although the Hafner, et al. injector has performed magnificently for many years, there remains room for improvement in providing a broader possible range of rate shaping at various operating conditions.

The present invention is directed to providing more flexibility and control to rate shaping through fuel spillage in hydraulically-actuated fuel injectors.

DISCLOSURE OF THE INVENTION

A hydraulically-actuated fuel injector includes an injector body that defines an actuation fluid cavity and a nozzle outlet, and further defines a low pressure area and a fuel pressurization chamber in fluid communication with a spill passage. A pumping element is positioned in the injector body and moveable between a retracted position and an advanced position. The pumping element has a first end exposed to fluid pressure in the actuation fluid cavity and a second end exposed to fluid pressure in the fuel pressurization chamber. An electronic spill valve is attached to the injector body and moveable between an open position in which the spill passage fluidly connects the fuel pressurization chamber to the low pressure area, and a closed position in which the spill passage is closed.

BEST MODE FOR CARRYING OUT THE INVENTION

Figure 1:
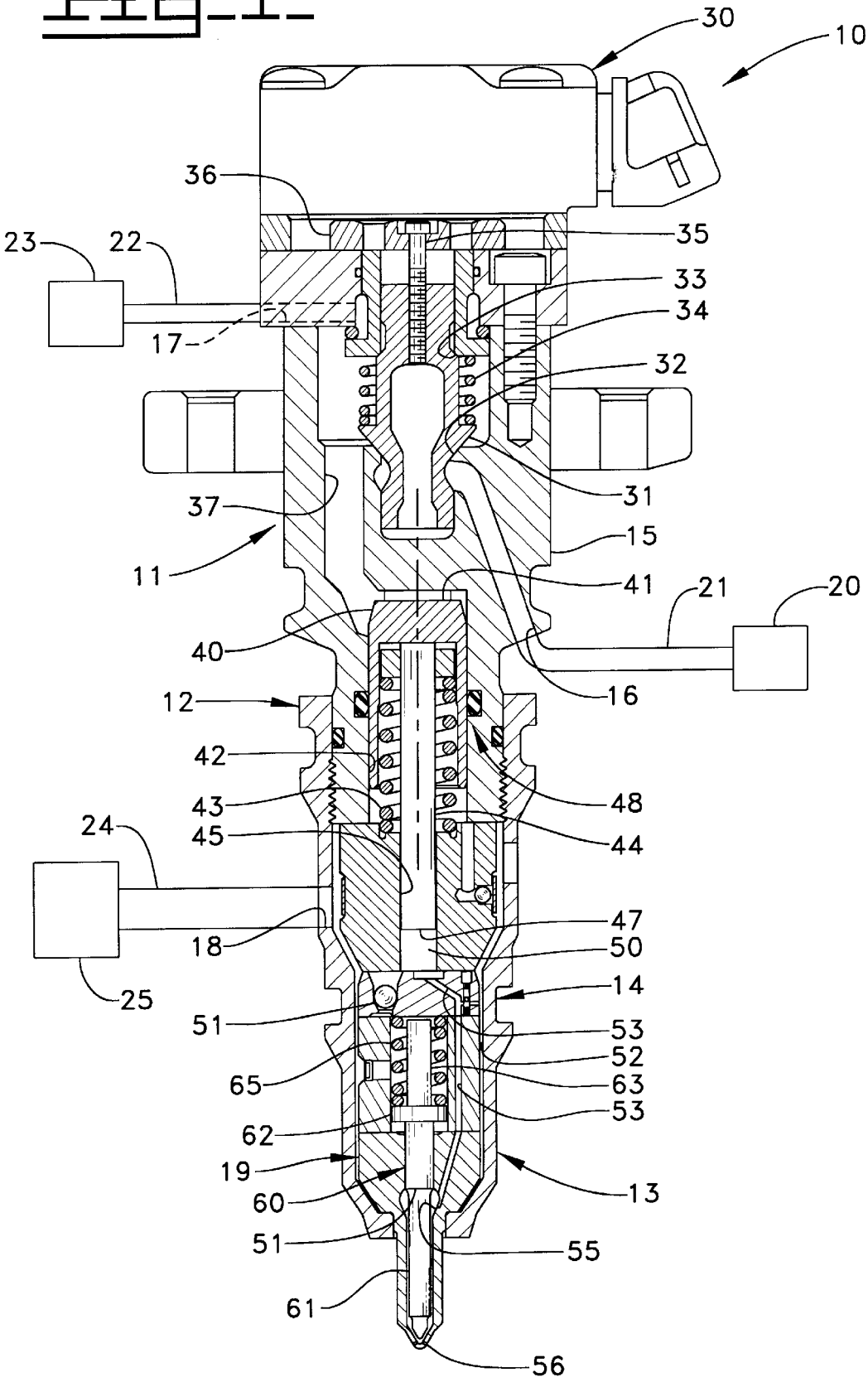
FIG. 1 is a side sectioned diagrammatic view of a hydraulically-actuated fuel injector according to the present invention.

Referring now to FIG. 1, a hydraulically-actuated fuel injector 10 includes a control valve assembly 11, a hydraulic pressurization assembly 12, a nozzle assembly 13, and a spill valve assembly 14. These various sub-assemblies are made up of various components attached together in a manner well known in the art to produce an injector body 15. Apart from defining various internal fluid flow passages and portions of these various sub-assemblies, injector body 15 defines a high pressure actuation fluid inlet 16 connected to a source of high pressure actuation fluid 20 via an actuation fluid supply line 21. A low pressure actuation fluid drain 17 is connected to a volume of low pressure actuation fluid 23, such as an oil pan, via a drain return line 22. Finally, injector body 15 defines a fuel inlet 18 connected to a source of fuel 25, preferably distillate diesel fuel, via a fuel supply line 24. Thus, in the preferred embodiment, hydraulically-actuated fuel injector 10 uses two distinct fluids in its operation; an actuation fluid, such as lubricating oil is used as the hydraulic medium, and a second fluid, such as distillate diesel fuel, is used as the injected fuel fluid.

The control valve assembly 11 includes an electrical actuator, such as a solenoid 30, and a moveable poppet valve member 31. In this case, poppet valve member 31 is attached to the armature portion 36 of solenoid 30 via a conventional fastener 35. Poppet valve member 31 is moveable between a lower high pressure seat 32 that closes actuation fluid inlet 16 and an upward low pressure seat 33 that closes low pressure actuation fluid drain 17. When solenoid 30 is de-energized, a biasing spring 34 pushes poppet valve member 31 downward to close high pressure seat 32 and open low pressure seat 33. When in this position, an actuation fluid cavity 37 defined by injector body 15 is opened to low pressure drain 17. When solenoid 30 is energized, poppet valve member 31 is pulled upward against the action of biasing spring 34 to a position that closes low pressure seat 33 and opens high pressure seat 32. When in this position, high pressure actuation fluid can flow from actuation fluid inlet 16 into actuation fluid cavity 37 to act on the top surface of a pumping element 48.

The hydraulic pressurization assembly 12 includes a pumping element 48, which is made up of an intensifier piston 40 and a plunger 44. Intensifier piston 40 is positioned in a piston bore 42, which is defined by injector body 15, and is moveable between a retracted position as shown, and a downward advanced position. Intensifier piston 40 includes a hydraulic surface 41 that is exposed to fluid pressure in actuation fluid cavity 37. Piston 40 is normally biased to its upward retracted position by a return spring 43. Plunger 44 is connected to move with piston 40, and moves in a plunger bore 45 defined by injector body 15. Plunger bore 45 and a hydraulic surface 47 of plunger 44 define a fuel pressurization chamber 50. Thus, pumping element 48 has an upper end exposed to fluid pressure in actuation fluid cavity 37, and a lower end exposed to fluid pressure in fuel pressurization chamber 50. In order to intensify the fuel pressure, hydraulic surface 41 is substantially larger than hydraulic surface 47. When pumping element 48 is undergoing its downward pumping stroke, fuel is pressurized in fuel pressurization chamber 50. When pumping element 48 is undergoing its upward return stroke between injection events, low pressure fuel is drawn into fuel pressurization chamber from fuel inlet 18, through low pressure area 52 and past check valve 51.

The nozzle assembly 13 includes a needle valve assembly 19 which includes a needle valve member 60 that is moveable between a downward closed position in which nozzle outlet 56 is blocked, and an upward opened position in which nozzle outlet 56 is open. Nozzle outlet 56 is fluidly connected to fuel pressurization chamber 50 via nozzle supply passage 53 and nozzle chamber 55. Needle valve member 60 includes a needle portion 61, a spacer portion 62, and a stop portion 63. Needle valve member 60 includes a lifting hydraulic surface 64 that is exposed to fluid pressure in nozzle chamber 55. Needle valve member 60 is normally biased downward to its closed position by a biasing spring 65. However, when fuel pressure acting on lifting hydraulic surface 64 is above a valve opening pressure, needle valve member 60 will lift against the action of biasing spring 65 to open nozzle outlet 56.

Figure 2:
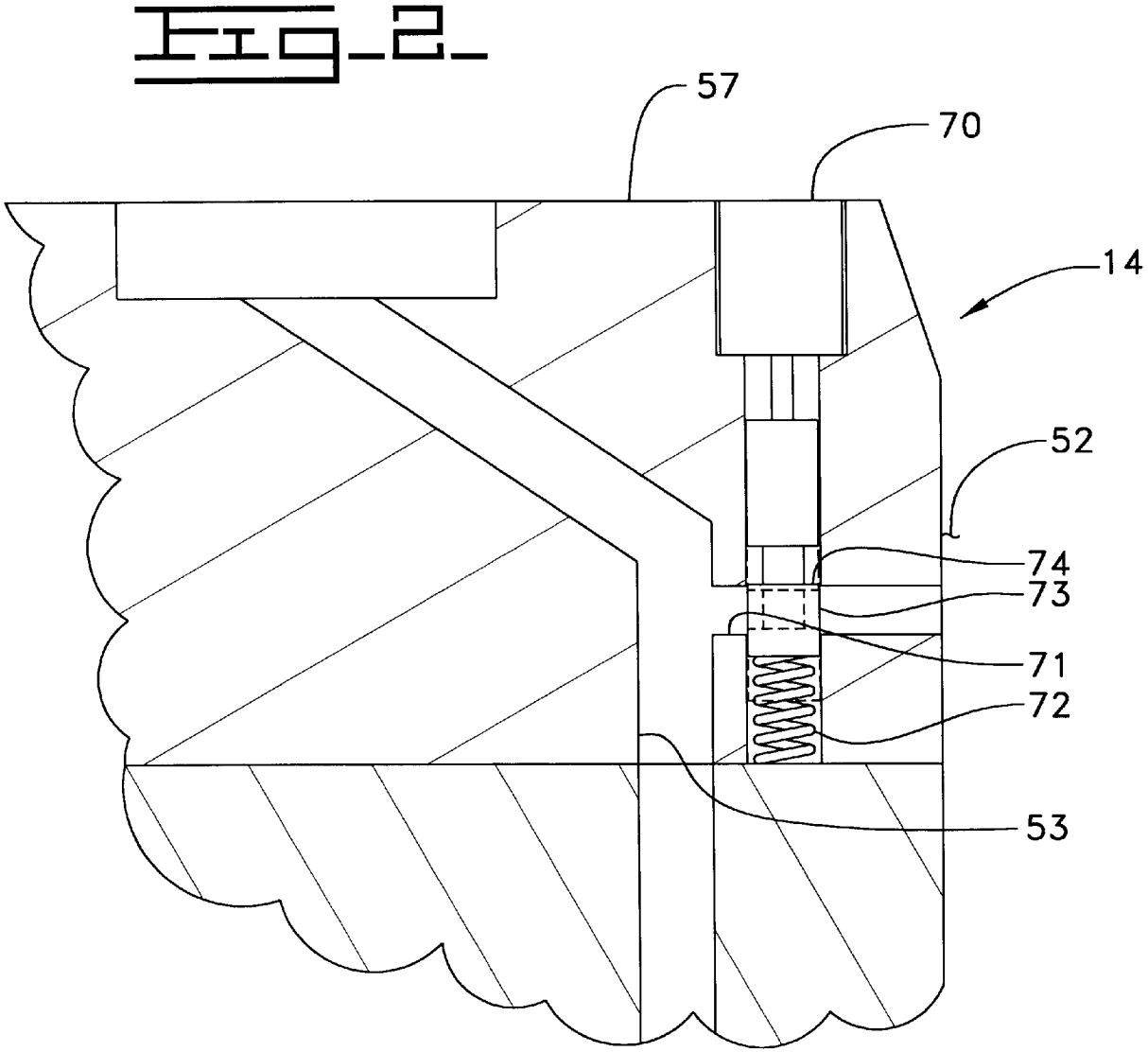
FIG. 2 is an enlarged side sectioned diagrammatic view of an electronic spill valve according to one aspect of the present invention.

Referring now in addition to FIG. 2, the spill valve assembly 14 includes a spool valve member 73 movably attached to an electrical actuator, such as a solenoid 70, a piezo-electric actuator, or other suitable electronic device. Those skilled in the art will appreciate that spool valve member 73 could be another type of valve member, such as a ball or poppet. Spool valve member 73 is moveable between a closed position, as shown, in which spill passage 71 is closed, and a downward opened position in which spill passage 71 is open. In this downward position, an annulus 74 defined by spool valve member 73 opens nozzle supply passage 53 to low pressure fuel area 52 via spill passage 71. When solenoid 70 is de-energized, spool valve member 73 is biased toward its upward closed position by a biasing spring 72. In the preferred embodiment, these various components are fitted into a stop component 57, which comprises a portion of injector body 15.

INDUSTRIAL APPLICABILITY

Referring again to FIGS. 1 and 2, fuel injector 10 is shown with its various moveable components positioned as they would be just prior to an injection event. In particular, solenoids 30 and 70 are de-energized, poppet valve member 31 is in its downward position closing high pressure seat 32, pumping element 48 is in its upward retracted position, spill spool valve member 73 is in its upward closed position, and needle valve member 60 is in its downward closed position to close nozzle outlet 56. Each injection event is initiated by energizing solenoid 30 to move poppet valve member 31 upward to close low pressure seat 33 and open high pressure seat 32. When this occurs, high pressure actuation fluid flows into actuation fluid cavity 37 from actuation fluid inlet 16. This high pressure actuation fluid acts on hydraulic surface 41 and begins moving pumping element 48 (piston 40 and plunger 44) downward for the pumping stroke. Downward movement of pumping element 48 closes check valve 51 and causes fuel pressure in fuel pressurization chamber 50 to quickly rise. When fuel pressure exceeds a valve opening pressure, needle valve member 60 lifts and the spray of fuel out of nozzle outlet 56 commences.

Each injection event is ended by de-energizing solenoid 30. This causes poppet valve member 31 to move back downward to close high pressure seat 32 and open low pressure seat 33. When this occurs, pressure acting on hydraulic surface 41 is relieved, and the pumping element 48 ceases its downward stroke. This in turn causes fuel pressure to rapidly drop below a valve closing pressure. When fuel pressure is sufficiently low, needle valve member 60 moves downward toward its closed position under the action of biasing spring 63 to close nozzle outlet 56 and end the injection event. Between injection events, return spring 43 pushes pumping element 48 upward toward its retracted position. When this occurs, fresh fuel is drawn into fuel pressurization chamber 50 past check valve 51. At the same time, the used actuation fluid in actuation cavity 37 is expelled toward reservoir 23 past low pressure seat 33 and through low pressure actuation fluid drain 17.

In order to extend fuel injector 10's range of operation, it preferably has the ability to control actuation fluid pressure in source 20. Thus, when it is desired to inject a relatively small amount of fuel, pressure in source 20 is relatively low, but pressure in source 20 is relatively high when it is desired to inject a relatively large amount of fuel, such as at a rated condition. While this flexibility allows fuel injector 10 to perform across the operational needs of most engines, there is often a desire to rate shape the injection at different engine operating conditions to produce certain desired results, such as reducing undesirable emissions, etc.

In order to introduce some rate shaping into injector 10, spill valve assembly allows a control system to spill fuel during an injection event to produce certain rate shaping effects. In the preferred embodiment, the flow area past spill valve assembly 14 is about equal to the spill flow area in the previously described Hafner injector so that the present invention has the ability to produce a split injection at idle conditions. Recalling that in the Hafner injector, its mechanically opened spill passage is large to produce a split injection at idle, but is not sufficiently large enough to produce a split injection at a rated condition. In order to duplicate the performance of the previously described Hafner injector, the flow area through the fuel spillage valve would preferably have an area about equal to that of the previously described Hafner injector. Thus, the present invention would allow one to produce a split injection at idle by briefly energizing and de-energizing solenoid 70 during pumping element 48's downward stroke. However, when the injector is operating at a rated condition, solenoid 70 would be left de-energized and no fuel spillage would occur.

In possible alternative embodiments, the flow area past spill valve assembly 14 could be adjusted such that the fuel injector would have the ability to produce boot shaped, or possibly split injections at rated operating conditions. In the case of a boot shaped injection, the flow area past spill valve assembly 14 would be such that fuel pressure would remain above the valve opening pressure, but would drop to reflect a lower fuel injection rate. Thus, for an appropriately sized spill valve assembly 14, a boot shaped injection could be created by initially energizing solenoid 70 to open spill valve assembly 14 for a beginning portion of the injection event, and then closing spill valve assembly 14 for a remaining portion of an injection event. In the case of a possible split injection, the flow area past spill valve assembly 14 would preferably have to be large enough to cause the fuel pressure to drop below the valve closing pressure so that the needle valve member would briefly close. Such an injection event would be created by maintaining solenoid 70 de-energized for a beginning portion of an injection event, briefly energizing the solenoid to cause a brief spill, and then again de-energizing solenoid 70 to reclose the spill valve member to initiate a second half of a split injection event.

The above description is intended for illustrated purposes only, and is not intended to limit the scope of the present invention in any way. For instance, different electrical actuators could be substituted in for the solenoids described, the spill valve assembly could be relocated in the injector body, such as possibly the barrel portion of the fuel injector, and the flow areas through the spill valve member could be adjusted to produce different injection rate profiles. Thus, various modifications could be made to the disclosed embodiment without otherwise departing from the intended spirit and scope of the present invention, which is defined by the claims set forth below.

What is claimed is:

1. A hydraulically actuated fuel injector comprising:

an injector body defining an actuation fluid cavity and a nozzle outlet, and further defining a low pressure area and a fuel pressurization chamber in fluid communication with a spill passage;

a pumping element positioned in said injector body and being movable between a retracted position and an advanced position, and having a first end exposed to fluid pressure in said actuation fluid cavity and a second end exposed to fluid pressure in said fuel pressurization chamber; and an electronic spill valve attached to said injector body and being movable between an open position in which said spill passage fluidly connects said fuel pressurization chamber to said low pressure area and a closed position in which said spill passage is closed.

2. The hydraulically actuated fuel injector of claim 1 wherein said electronic spill valve includes an electrical actuator attached to a spill valve member.

3. The hydraulically actuated fuel injector of claim 1 wherein said spill passage opens into a nozzle supply passage that extends between said fuel pressurization chamber and said nozzle outlet; and said electronic spill valve includes a spool valve member.

4. The hydraulically actuated fuel injector of claim 1 wherein said electronic spill valve includes a solenoid and a spill valve member positioned in said injector body.

5. The hydraulically actuated fuel injector of claim 1 having an operating range and further comprising a needle valve assembly positioned in said injector body and defining a valve opening pressure; and said spill passage has a flow area sufficiently large to drop fuel pressure in said fuel pressurization chamber below said valve opening pressure over a portion of said operating range.

6. The hydraulically actuated fuel injector of claim 1 further comprising a needle valve member positioned in said injector body;

said injector body including a stop component that defines a portion of said spill passage; and said needle valve member being movable between a closed position in which said nozzle outlet is closed, and an open position in which said needle valve member is in contact with said stop component.

7. The hydraulically actuated fuel injector of claim 1 further comprising an electronic control valve attached to said injector body and being movable between an on position in which said actuation fluid cavity is open to a source of high pressure actuation fluid, and an off position in which said actuation fluid cavity is open to a low pressure return.

8. The hydraulically actuated fuel injector of claim 1 wherein said injector body defines a fuel inlet connected to a source of fuel; and said injector body defines an actuation fluid inlet connected to a source of actuation fluid that is different from said fuel.

9. The hydraulically actuated fuel injector of claim 1 wherein said first end has a first hydraulic surface and said second end has a second hydraulic surface; and said first hydraulic surface is greater than said second hydraulic surface.

10. A hydraulically actuated fuel injector comprising:

an injector body defining an actuation fluid cavity and a nozzle outlet, and further defining a low pressure area and a fuel pressurization chamber in fluid communication with a spill passage;

a pumping element positioned in said injector body and being movable between a retracted position and an advanced position, and having a first end exposed to fluid pressure in said actuation fluid cavity and a second end exposed to fluid pressure in said fuel pressurization chamber;

an electronic spill valve positioned in said injector body and including a spill valve member movable between an open position in which said spill passage fluidly connects said fuel pressurization chamber to said low pressure area and a closed position in which said spill passage is closed;

a fuel inlet being connected to a source of low pressure fuel; and an actuation fluid inlet being connected to a source of high pressure actuation fluid that is different from fuel.

11. The hydraulically actuated fuel injector of claim 10 wherein said electronic spill valve includes an electrical actuator attached to a spill valve member.

12. The hydraulically actuated fuel injector of claim 11 wherein said electrical actuator is a solenoid; and said spill valve member is a spool valve member.

13. The hydraulically actuated fuel injector of claim 12 wherein said spill passage opens into a nozzle supply passage that extends between said fuel pressurization chamber and said nozzle outlet.

14. The hydraulically actuated fuel injector of claim 12 having an operating range and further comprising a needle valve assembly positioned in said injector body and defining a valve opening pressure; and said spill passage has a flow area sufficiently large to drop fuel pressure in said fuel pressurization chamber below said valve opening pressure over a portion of said operating range.

15. The hydraulically actuated fuel injector of claim 12 further comprising a needle valve member positioned in said injector body;

said injector body including a stop component that defines a portion of said spill passage; and said needle valve member being movable between a closed position in which said nozzle outlet is closed, and an open position in which said needle valve member is in contact with said stop component.

16. The hydraulically actuated fuel injector of claim 12 further comprising an electronic control valve attached to said injector body and being movable between an on position in which said actuation fluid cavity is open to said source of high pressure actuation fluid, and an off position in which said actuation fluid cavity is open to a low pressure return.

17. The hydraulically actuated fuel injector of claim 12 wherein said first end has a first hydraulic surface and said second end has a second hydraulic surface; and said first hydraulic surface is greater than said second hydraulic surface.

18. A hydraulically actuated fuel injector comprising:

an injector body defining an actuation fluid cavity and a nozzle outlet, and further defining a low pressure area and a fuel pressurization chamber in fluid communication with a spill passage;

an electronic control valve attached to said injector body and being movable between an on position in which said actuation fluid cavity is open to a source of high pressure actuation fluid, and an off position in which said actuation fluid cavity is open to a low pressure return;

a pumping element positioned in said injector body and being movable between a retracted position and an advanced position, and having a first hydraulic surface exposed to fluid pressure in said actuation fluid cavity and a second hydraulic surface exposed to fluid pressure in said fuel pressurization chamber;

an electronic spill valve positioned in said injector body and including a spill valve member movable between an open position in which said spill passage fluidly connects said fuel pressurization chamber to said low pressure area and a closed position in which said spill passage is closed;

said first hydraulic surface being greater than said second hydraulic surface;

a fuel inlet being connected to a source of low pressure fuel; and a actuation fluid inlet being connected to said source of high pressure actuation fluid, which is different from fuel.

19. The hydraulically actuated fuel injector of claim 18 wherein said electronic spill valve includes a solenoid attached to a spool valve member.

20. The hydraulically actuated fuel injector of claim 19 having an operating range that includes an idle condition, and further comprising a needle valve assembly positioned in said injector body and defining a valve opening pressure; and said spill passage has a flow area sufficiently large to drop fuel pressure in said fuel pressurization chamber below said valve opening pressure when operating at said idle condition.

* * * * *